US006652296B2

(12) United States Patent
Kuroda et al.

(10) Patent No.: US 6,652,296 B2
(45) Date of Patent: Nov. 25, 2003

(54) ELECTRIC CONNECTOR FOR SHIELDED CABLE, A CONNECTOR BODY THEREOF AND A METHOD OF PRODUCING THE ELECTRIC CONNECTOR

(75) Inventors: Keiji Kuroda, Amagasaki (JP); Hideaki Horiuchi, Suita (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/224,929

(22) Filed: Aug. 20, 2002

(65) Prior Publication Data

US 2003/0040203 A1 Feb. 27, 2003

(30) Foreign Application Priority Data

Aug. 24, 2001 (JP) ..... 2001-255383

(51) Int. Cl.[7] ..... H01R 4/66
(52) U.S. Cl. ..... 439/95; 439/607
(58) Field of Search ..... 439/98, 607, 99, 439/95

(56) References Cited

U.S. PATENT DOCUMENTS 5,176,538 A * 1/1993 Hansell, III et al. ..... 439/607
6,273,758 B1 * 8/2001 Lloyd et al. ..... 439/607
6,428,344 B1 * 8/2002 Reed ..... 439/455
6,443,773 B1 * 9/2002 Korsunsky et al. ..... 439/660
6,524,135 B1 * 2/2003 Feldman et al. ..... 439/610

FOREIGN PATENT DOCUMENTS

| | | |
|---|---|---|
| JP | 5-8884 | 2/1993 |
| JP | 07094245 | 4/1995 |
| JP | 10500245 | 1/1998 |
| WO | WO 95/20252 | 7/1995 |

* cited by examiner

*Primary Examiner*—Tulsidas C Patel
(74) *Attorney, Agent, or Firm*—W. F. Fasse; W. G. Fasse

(57) ABSTRACT

An electric connector for shielded cable, which improves the reliability of connection between a ground terminal and an external conductor and secures stable impedance characteristics. In this electric connector, a first housing is primarily molded on the external conductor, the external conductor is provided with a support protrusion that protrudes inside of the external conductor and contacts the ground terminal, and the second housing being secondarily molded is provided with a through hole, which is formed by a core pin that protrudes inwards from a mold and presses the ground terminal at a position where the second housing faces the support protrusion with the ground terminal in between.

16 Claims, 9 Drawing Sheets

ELECTRIC CONNECTOR FOR SHIELDED CABLE, A CONNECTOR BODY THEREOF AND A METHOD OF PRODUCING THE ELECTRIC CONNECTOR

BACKGROUND OF THE INVENTION

1. Field of the Invention

The present invention belongs to a field of electric connectors that are used to connect shielded cables having both a signal line and a ground line and enable, depending on applications, high-speed transmission of signals. The present invention relates to an electric connector having a conductive plate-shaped external conductor to which a ground terminal is grounded, and relates to an electric connector wherein the reliability of connection between a ground terminal and an external conductor is improved and its producibility is enhanced.

2. Related Art

Electric connectors for shielded cable are known, which comprise a conductive tubular external conductor, an insulating housing being contained inside the external conductor, and a signal terminal and a ground terminal both being contained inside the housing, and wherein the signal terminal is to be connected to a signal line of the shielded cable and the ground terminal is to be connected to a ground line thereof, respectively (refer to, for example, Japanese Patent unexamined publication gazette Heisei 7-94245 and Japanese Utility Model unexamined publication gazette Heisei 5-8884). In these electric connectors, connection of the ground terminal to the external conductor is effected by providing the ground terminal with an elastic piece, which can undergo elastic deformation, and making this elastic piece contact the inside of the external conductor.

In an electric connector disclosed in Japanese national publication gazette of translated version Heisei 10-500245, a signal terminal and a ground terminal are held between a housing and a cover each of which are produced by molding an insulating part on an external conductor. In this electric connector, connection of the ground terminal to the external conductor is effected by providing a groove, which is made in the housing to position the ground terminal, with an opening to expose the external conductor, and making the ground terminal contact the external conductor at the opening.

These conventional electric connectors have problems that, as the ground terminal and the external conductor are connected together by making them contact each other, if the contact between them become unstable due to some causes such as vibration, the impedance characteristics will fluctuate and prevent, for example, stable high-speed transmission of signals.

One solution to this problem may be soldering the ground terminal to the external conductor. However, it will add a soldering process and complicate the wire connection work. Moreover, as it is difficult to keep the quantity of the solder at a constant level, it will impose a new problem that the impedance characteristics will vary from product to product. This problem is also encountered when connection between a terminal and a shielded cable is made by soldering.

The electric connectors of this kind are required to be made thinner, in particular, it is desired that they are not bulky when they are used in layers.

SUMMARY OF THE INVENTION

The present invention was made in view of these points, and its objective is to provide an electric connector wherein a first insulating housing is primarily molded on a plate-shaped external conductor, a crimp-type signal terminal and a crimp-type ground terminal are engaged with the first insulating housing, and a second insulating housing is secondarily molded on them to make the ground terminal contact hard the external conductor to improve the reliability of connection between them and secure more stable impedance characteristics, and also to eliminate any soldering process to improve the producibility through reduction in work processes and equalize impedance characteristics of the products, and to realize a thinner design. Further objective of the present invention is to press the ground terminal by a core pin at the time of the secondary molding so as to effectively prevent the ground terminal from being shifted or deformed under the pressure of an insulating material being molded secondarily and the insulating material from penetrating between the ground terminal and the external conductor and causing defective connection between the ground terminal and the external conductor.

To accomplish the above-mentioned objectives, the electric connector for shielded cable according to the present invention is an electric connector, which is used for connecting a shielded cable having a signal line and a ground line. This electric connector comprises a conductive plate-shaped external conductor, an insulating first housing being primarily molded on the inside of the external conductor, a signal terminal having a contacting part at one end thereof, which contacts a counterpart terminal, and a barrel on the other end thereof, which crimps the signal line of the shielded cable, and being arranged on the inside of the first housing in one direction, a ground terminal having a contacting part at one end thereof, which contacts a counterpart terminal, and a barrel on the other end thereof, which crimps the ground line of the shielded cable, and being arranged on the inside of the first housing in the same direction as the signal terminal, a engaging mechanism for engaging the signal terminal and the ground terminal onto the first housing, and an insulating second housing being secondarily molded to sandwich the signal terminal and the ground terminal between itself and the first housing, wherein the external conductor is provided with a support protrusion, which is formed to protrude inside of the external conductor to contact the ground terminal, and the second housing is provided with a through hole, which is formed by a core pin that protrudes inward from a mold and presses the ground terminal, at a position where the second housing faces the support protrusion with the ground terminal in between.

In this electric connector for shielded cable, as the second housing is molded secondarily on the ground terminal, the ground terminal is made to contact hard the external conductor and the reliability of connection between them is improved, and in turn, more stable impedance characteristics are obtained. The signal line of the shielded cable is crimped in the barrel of the signal terminal, the ground line of the shielded cable is crimped in the barrel of the ground terminal, and the ground terminal is made to contact the support protrusion of the external conductor. As a result, there is no soldering process, and the work processes are reduced and the producibility is enhanced, and moreover, the impedance characteristics of the products are equalized. Furthermore, as the major parts are formed by overlaying the plate-shaped external conductor, the first housing, the signal terminal and the ground terminal, and the second housing, the electric connector can be made thinner.

When the second housing is molded secondarily, as the core pin presses the ground terminal against the support protrusion at the position of the through hole, the ground terminal will not be shifted or deformed under the pressure of the insulating material being secondarily molded, and the insulating material will not penetrate between the ground terminal and the support protrusion. Hence the secondary molding is effectively prevented from causing any defective connection between the ground terminal and the external conductor.

Accordingly, in the electric connector for connecting a shielded cable according to the present invention, as the second housing is molded secondarily, the ground terminal is made to contact hard the external conductor and the reliability of connection between them is improved and more stable impedance characteristics are obtained, and this allows, for example, stable high-speed transmission of signals. In this case, as the ground terminal is pressed by the core pin, the ground terminal is effectively prevented from being shifted or deformed and the insulating material is effectively prevented from penetrating between the ground terminal and the support protrusion to cause any defective connection between the ground terminal and the external conductor. Moreover, as there is no soldering process, the producibility is enhanced through reduction in the work processes and the impedance characteristics of the products are equalized. Furthermore, the electric connector can be made thinner, and this is desirable when such electric connectors are used in layers.

PREFERRED EMBODIMENTS OF THE INVENTION

Figure 1:
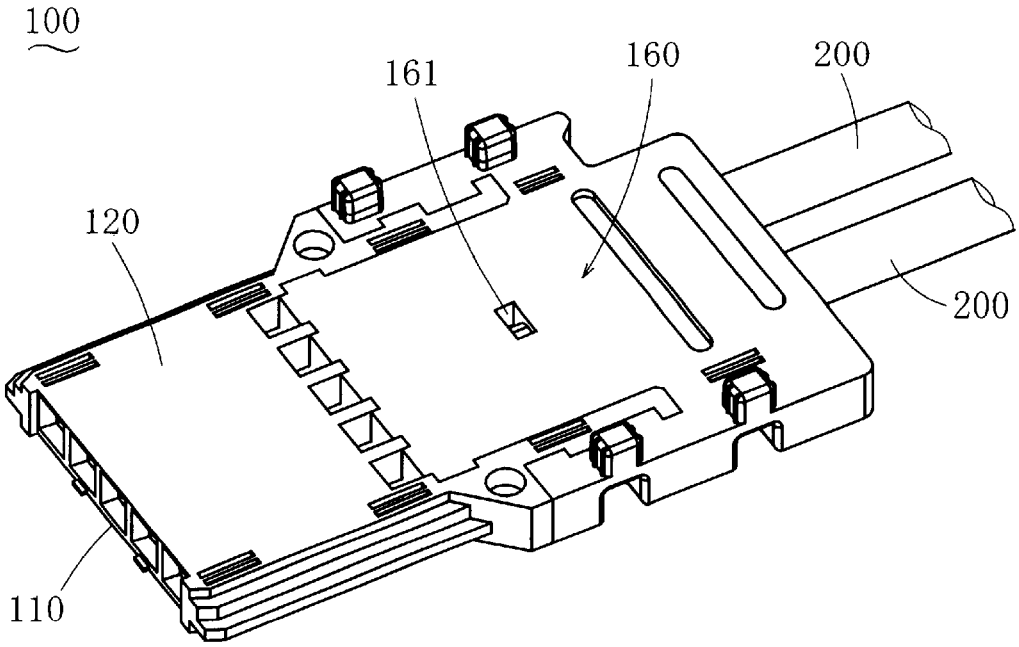
FIG. 1 is a perspective view of the first embodiment of the electric connector according to the present invention.
Figure 2:
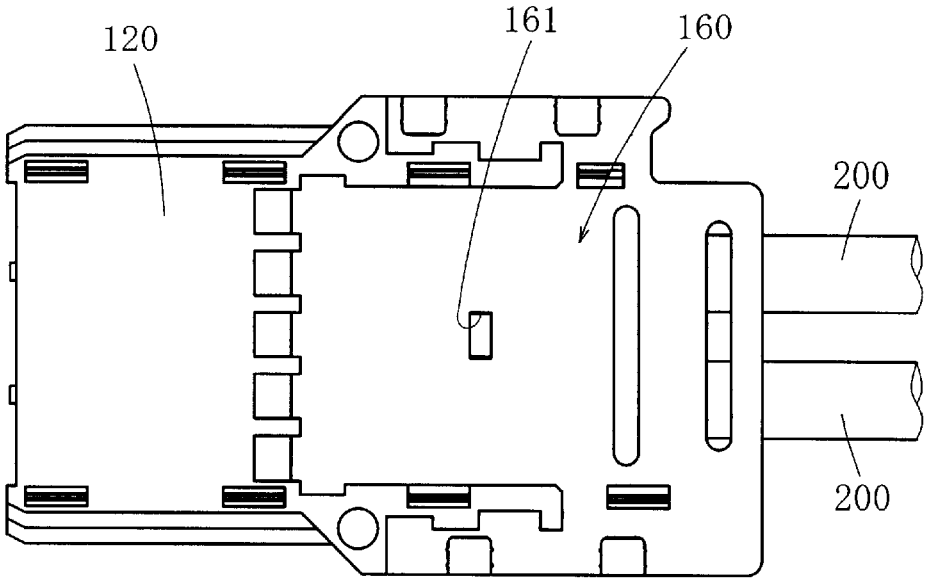
FIG. 2 is a plan view of the electric connector.

In the following, some embodiments of the present invention will be described. FIG. 1 through FIG. 5 show the first embodiment of the electric connector for shielded cable. This electric connector is provided with five female terminals and two shielded cables are connected to it. Each of these female terminals is to be connected to a counterpart male terminal that is mounted on a printed circuit board. The electric connector is used to transmit signals of computers. The first embodiment, however, merely exemplifies a preferred embodiment, and the number of poles of the electric connector according to the present invention, kind and number of shielded cables to be connected, application, form of counterpart terminals, etc. are not limited in any way by the first embodiment. The terminals of the electric connector according to the present invention may be male terminals. A shielded cable has at least one signal line and at least one ground line, and these lines are contained together in an insulating covering. Such shielded cables include those called coaxial cables and bipolar cables. Accordingly, the present invention is applicable to any electric connector that is provided with at least one signal terminal and at least one ground terminal. Moreover, as will be described below, any forms wherein two or more shielded cables are connected to one electric connector of the present invention, any forms wherein one shielded cable is connected to two or more electric connectors of the present invention, and combinations of these forms are included in the embodiments.

As shown in FIG. 1 through FIG. 5, the electric connector 100 comprises a conductive plate-shaped external conductor 110, an insulating first housing 120, signal terminals 130 and a ground terminal 140 that are arranged on the inside of the first housing 120, a engaging mechanism 150 that engages the signal terminals 130 and the ground terminal 140 with the first housing 120, and an insulating second housing 160.

Figure 6:
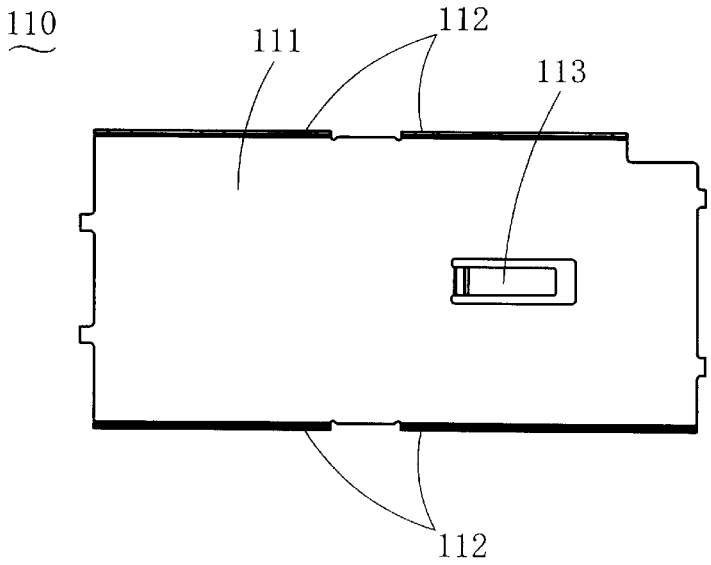
FIG. 6 is a plan view of the external conductor of the electric connector.
Figure 7:
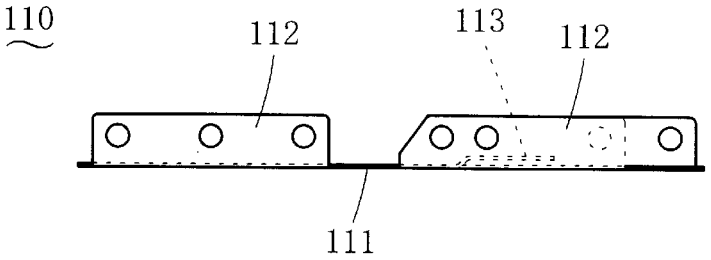
FIG. 7 is a side view of the external conductor.
Figure 8:
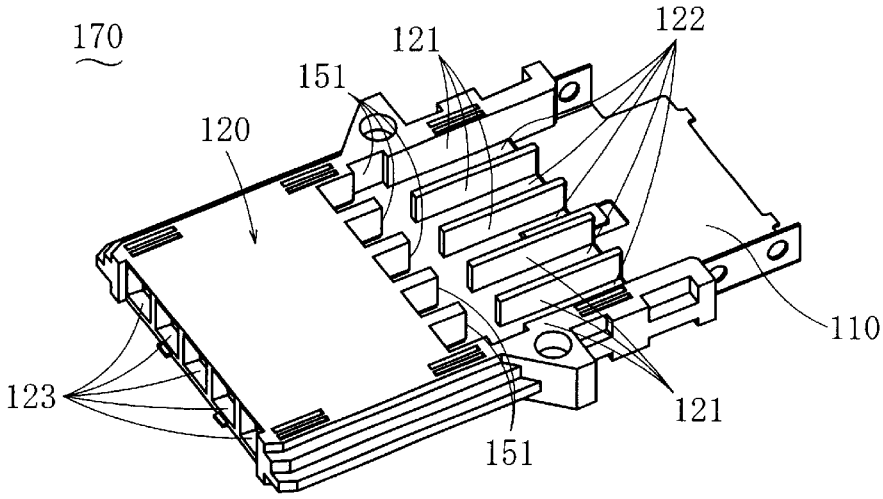
FIG. 8 is a perspective view of the connector body of the first embodiment.
Figure 9:
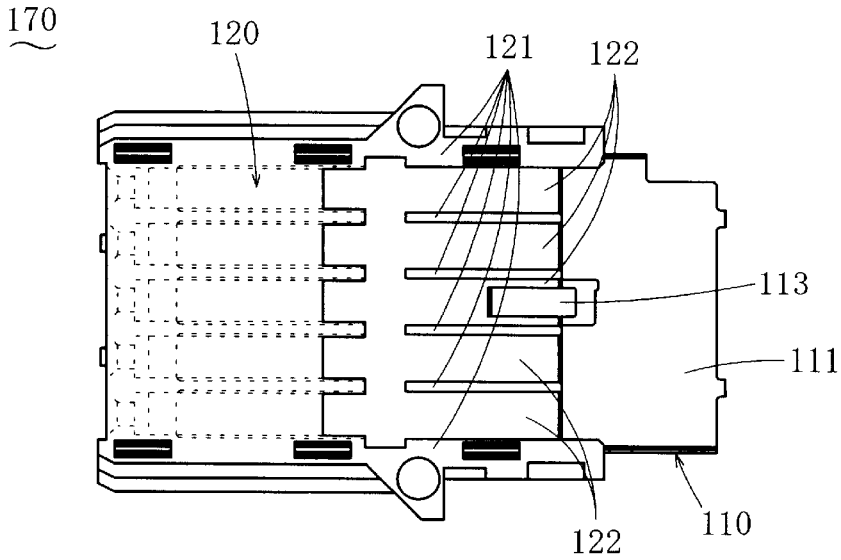
FIG. 9 is a plan view of the connector body.
Figure 10:
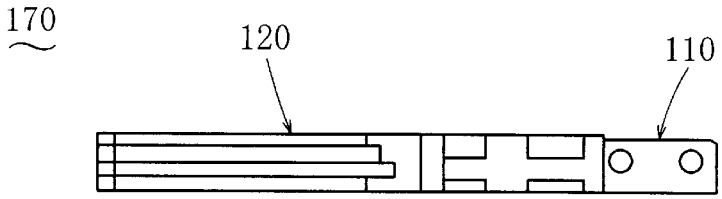
FIG. 10 is side view of the connector body.
Figure 11:
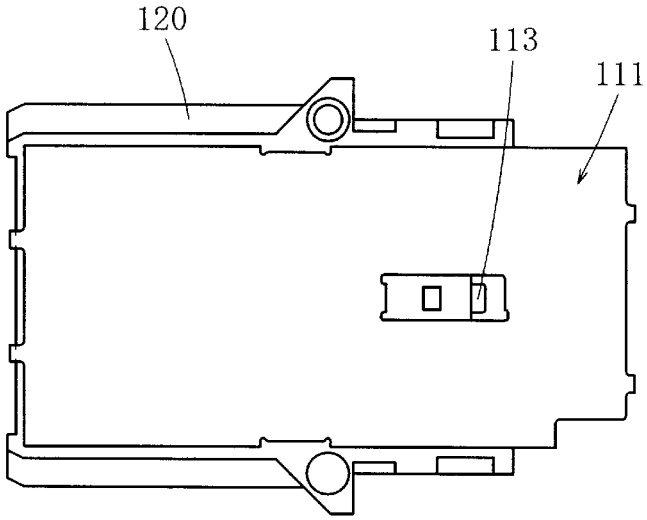
FIG. 11 is a bottom view of the connector body.
Figure 12:
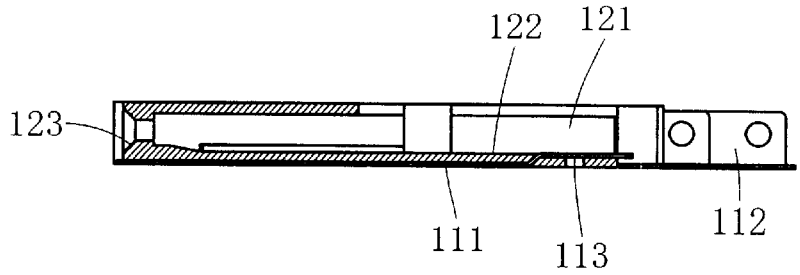
FIG. 12 is a sectional view of the connector body.

As shown in FIG. 6 and FIG. 7, the external conductor 110 is made of a material that has conductivity and can exhibit a shielding effect. The external conductor 110 comprises a base plate 111 and side plates 112, which rise almost perpendicular to the base plate 111 from two opposing sides thereof towards the inside of the base plate 111. Openings may be made in the side plates 112 as necessary. The external conductor 110 may be the base plate 111 only. Provision of the side plates 112, however, is preferable from the viewpoint of increasing the binding force between the external conductor 110 and the first housing 120.

The first housing 120 is formed of a material that can be injection-molded, for example, a synthetic resin. As shown in FIG. 8 through FIG. 12, the first housing 120 is primarily molded on the inside of the external conductor 110. This electric connector 100 is molded by two cycles of injection molding. Of these cycles, the first one is called the primary molding, and the second one the secondary molding. In the first housing 120, partition walls 121 are raised in parallel to each other, and grooves 122 for storing respective terminals 130, 140 are formed between these partition walls 121. One end of each groove 122 constitutes a connecting port 123 that allows each terminal 130, 140 to contact its counterpart terminal. Near the connecting port 123, the open part of the groove 122 is closed by a wall to form a through hole. This wall may be omitted, but provision of the wall is preferable because the wall can easily and reliably prevent the material of the second housing 160 from entering into the contacting parts 132, 142 of the terminals 130, 140 at the time of the secondary molding.

Figure 13:
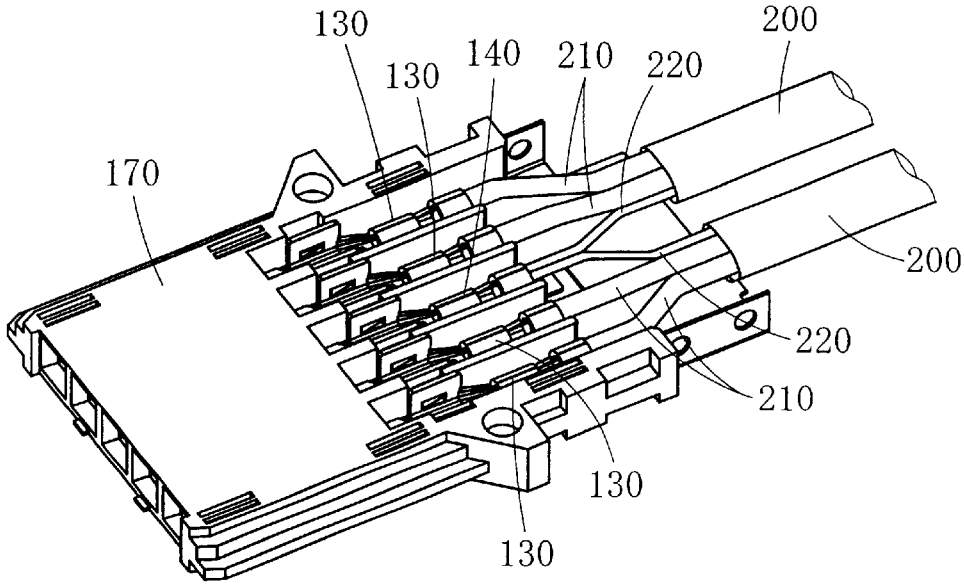
FIG. 13 is a perspective view of the electric connector without the second housing.
Figure 14:
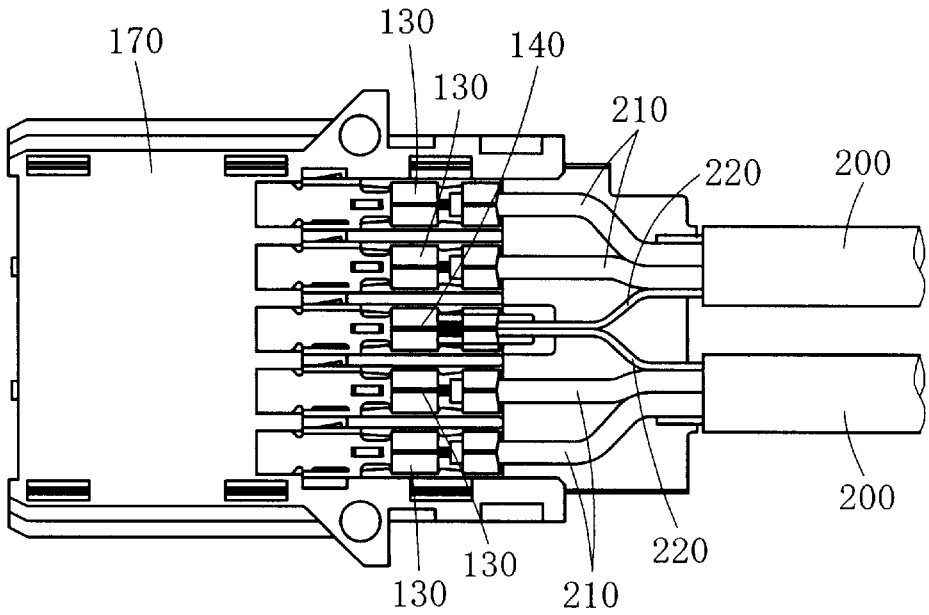
FIG. 14 is plan view of the electric connector without the second housing.
Figure 15:
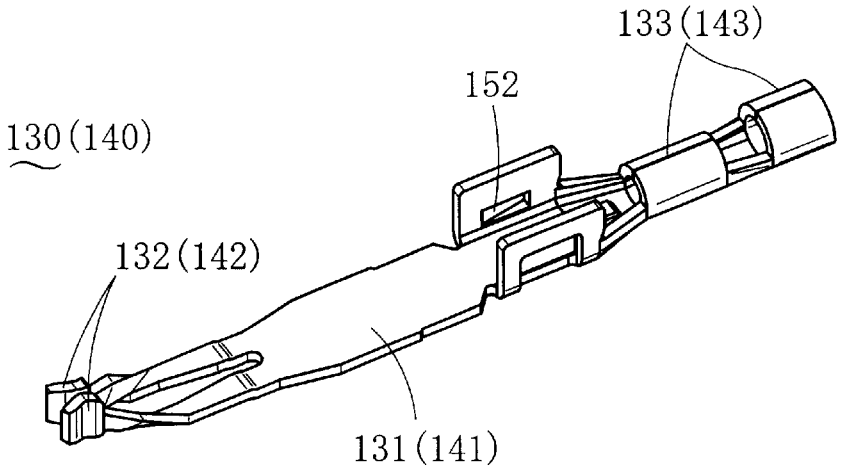
FIG. 15 is an enlarged perspective view of a signal terminal of the electric connector. As the ground terminal is identical to it, corresponding marks are shown in parentheses.
Figure 16:
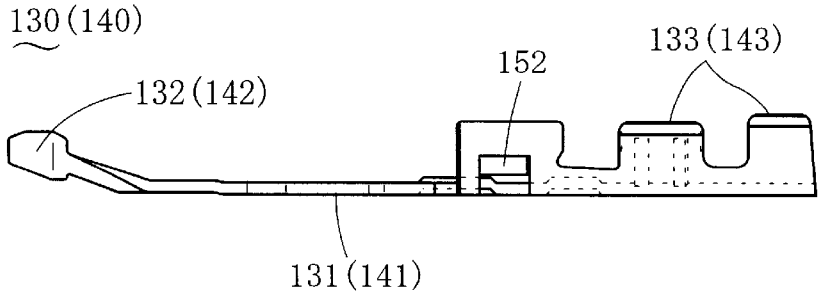
FIG. 16 is an enlarged side view of the signal terminal of the electric connector. As the ground terminal is identical to it, corresponding marks are shown in parentheses.
Figure 17:
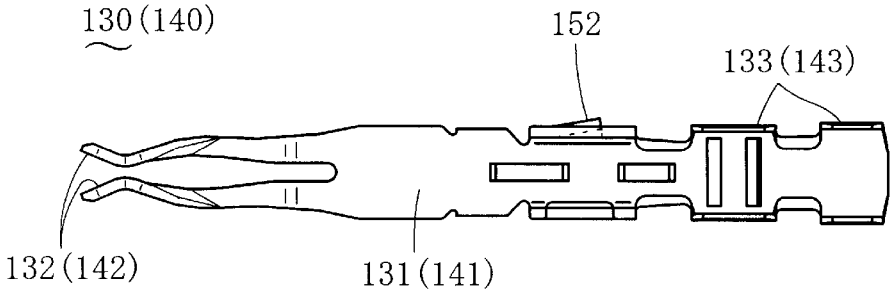
FIG. 17 is an enlarged plan view of the signal terminal of the electric connector. As the ground terminal is identical to it, corresponding marks are shown in parentheses.

As shown in FIG. 13 and FIG. 14, the signal terminals 130 are arranged on the inside of the first housing 120 in one direction. The signal terminals 130 of this embodiment are stored in the grooves 122 of the first housing 120 in such a way that the contacting parts 132 thereof are positioned at the connecting ports 123. As shown in FIG. 15 through FIG. 17, each signal terminal 130 has, at one end thereof, a contacting part 132 that is to contact the counterpart terminal, and at the other end thereof, a barrel 133 that crimps a signal line 210 of a shielded cable 200. The signal terminal 130 of this embodiment is formed of a plate material and has a bottom plate 131 being a major part. The contacting part 132 is formed at one end of the bottom plate 131, and a barrel 133 is formed at the other end thereof.

As shown in FIG. 13 and FIG. 14, the ground terminal 140 is arranged on the inside of the first housing 120 in the same direction as the signal terminals 130. The ground terminal 140 of this embodiment is stored in a groove 122 of the first housing 120 in such a way that the contacting part 142 thereof is positioned at the connecting port 123. In this embodiment, the ground terminal 140 has the same configuration as the signal terminals 130. In other words, as shown in FIG. 15 through FIG. 17 by marks in parentheses, the ground terminal 140 has, at one end thereof, a contacting part 142 that contacts the counterpart terminal and, at the other end thereof, a barrel 143 that crimps a ground line 220 of the shielded cable 200. The ground terminal 140 is formed of a plate material and has a bottom plate 141 being a major part thereof, and a contacting part 142 is formed at one end of the bottom plate 141, and a barrel 143 is formed at the other end thereof. It is not necessary for the ground terminal 140 to have the same configuration as the signal terminals 130. For example, in the case of this embodiment, each barrel 133, 143 of the terminal 130, 140 is divided into a wire barrel and an insulation barrel that are known well. However, it is not necessary to divide the barrel in the ground terminal. This electric connector 100 is connected to two shielded cables 200. Each shielded cable 200 comprises two signal lines 210 and one ground line 220 all being contained together in one insulating covering. Thus a total of four signal lines 210 are crimped to four signal terminals 130, and a total of two ground lines 220 are jointly crimped to one ground terminal 140.

The engaging mechanism 150 comprises windows 151 that are opened in the partition walls 121 of the first housing 120 and engaging pieces 152 that are formed on the signal terminals 130 and the ground terminal 140 so that they are engaged with the windows 151. The engaging pieces 152 are formed by raising side walls from the bottom plates 131, 141 of the signal terminals 130 and the ground terminal 140 and cutting and raising a part of the side walls sidewise and outwards. When the signal terminals 130 and the ground terminal 140 are inserted into the grooves 122 in their longitudinal direction, these engaging pieces 152 will engage with the windows 151, and this in turn will engage the signal terminals 130 and the ground terminal 140 with the first housing 120. This is a engaging mechanism using the so-called contact lance. In place of this mechanism, the engaging mechanism using the so-called housing lance may be used. In that case, for example, the engaging pieces are provided on the first housing, and the windows or concaved parts into which the engaging pieces fit are provided on the signal terminals and the ground terminal. A weak connecting force is tolerated in the present invention in comparison with the case wherein the second housing 160 is not provided by the secondary molding. The present invention includes embodiments wherein this connecting force is set substantially high.

The second housing 160 is formed of a material that can be injection-molded, for example, a synthetic resin. As shown in FIG. 1 through FIG. 5, the second housing 160 is secondarily molded to sandwich the signal terminals 130 and the ground terminal 140 between itself and the first housing 120. The second housing 160 is secondarily molded in such a way that it presses and covers the ground terminal 140 at least around a support protrusion 113, which will be described below.

On the external conductor 110, a support protrusion 113 is formed, which protrudes inside of the external conductor 110 and contacts the ground terminal 140. This support protrusion 113 is connected to the external conductor 110 so that the support protrusion 113 and the external conductor 110 are electrically continuous to each other. In this embodiment, the support protrusion 113 is provided by cutting and raising a part of the external conductor 110, thus the support protrusion 113 is provided integrally to the external conductor 110. Other forms of the support protrusion include, for example, a dimple, which is raised up from the external conductor 110.

The second housing 160 is provided with a through hole 161 at a position at which the second housing 160 faces the support protrusion 113 with the ground terminal 140 in between. This through hole 161 is formed by a core pin 341, which, as will be described below, protrudes inwardly from a mold 320 and presses the ground terminal 140.

Figure 3:
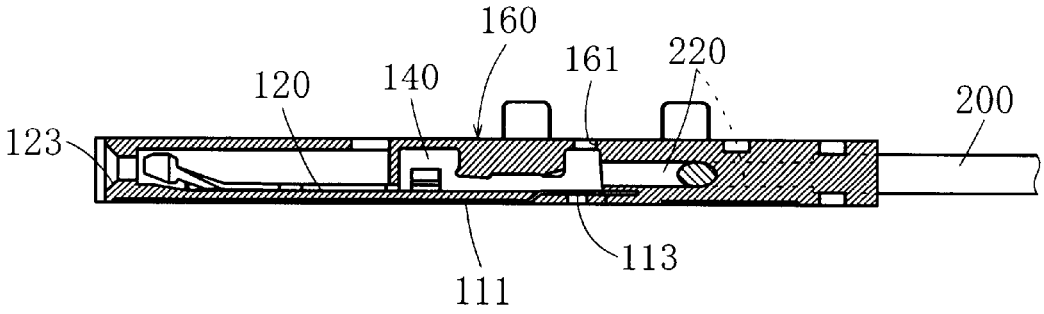
FIG. 3 is a sectional view of the electric connector. The external conductor and the housings are cut, but the ground terminal and the wire near its barrel are not cut.
Figure 4:
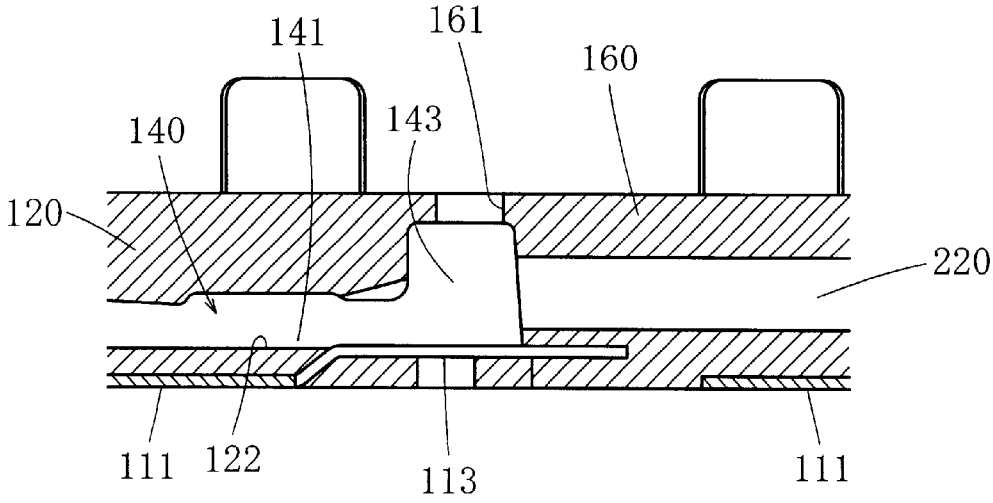
FIG. 4 is an enlarged sectional view of a part of the electric connector. The external conductor and the housings are cut, but the ground terminal and the wire near its barrel are not cut.
Figure 5:
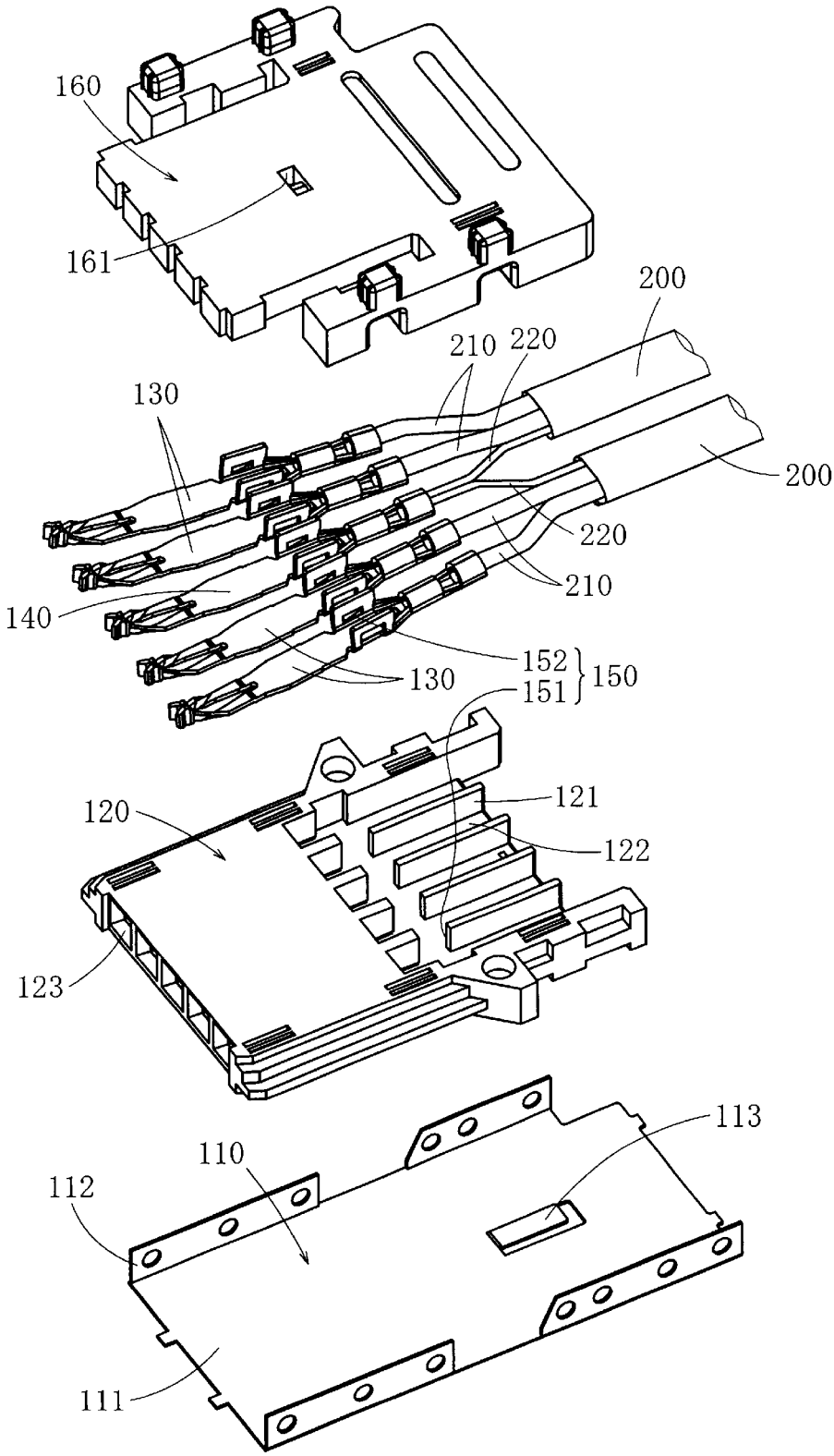
FIG. 5 is an exploded perspective view of the electric connector.

As shown in FIG. 3 and FIG. 4, the ground terminal 140 is stored in a groove 122 of the first housing 120 in such an orientation that the bottom plate 141 thereof contacts the bottom of the groove 122. And the ground terminal 140 contacts the support protrusion 113 by its bottom plate 141.

The support protrusion 113 penetrates the first housing 120 and protrudes from the inside thereof. The outside of the support protrusion 113 contacts the first housing 120 and is supported by the first housing 120. The outside of the support protrusion 113 is the lower face in FIG. 3 and FIG. 4. In this embodiment, the support protrusion 113 comprises a riser, which rises inside from the external conductor 110, and a tip, which extends from this riser in parallel with the external conductor 110. A part of the first housing 120 extends to the outside of this tip, and this part of the first housing 120 contacts the outside of the tip and prevents the support protrusion 113 from being deformed outwards. As the support protrusion 113 is supported on its outside by the first housing 120 as described above, it has sufficient rigidity to resist the pressing force of the core pin 341 that will be described below. The support protrusion 113 of this embodiment is distinguished by this point from the elastic pieces of the related art.

It is a connector body 170 that is obtained in an intermediate stage of the production of the electric connector 100 of the above-mentioned first embodiment. As shown in FIG. 8 through FIG. 12, this connector body 170 comprises the conductive plate-shaped external conductor 110 and the insulating first housing 120, which is primarily molded on the inside of the external conductor 110. The support protrusion 113, which protrudes inwards and can contact the ground terminal 140, is formed on the external conductor 110. On the inside of the first housing 120, windows 151 being parts of the engaging mechanism 150, which engages the signal terminals 130 and the ground terminal 140 with the first housing 120, are provided. An area around the support protrusion 113 is exposed so that the second housing 160 can be molded secondarily.

Figure 18:
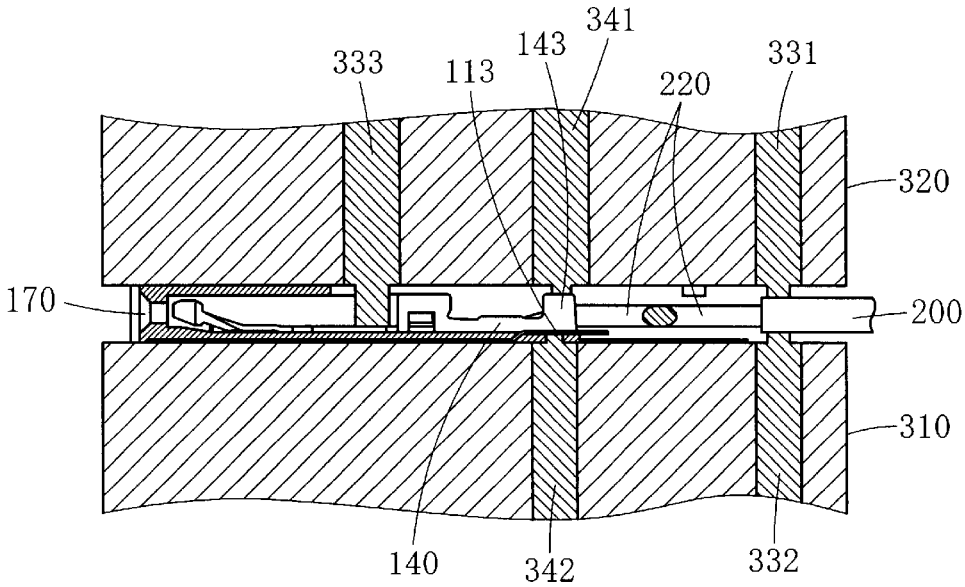
FIG. 18 is a sectional view showing the state before the secondary molding of the second housing in the third process of the production method of the electric connector. The external conductor and the housing are cut, but the ground terminal and the wire near its barrel are not cut.
Figure 19:
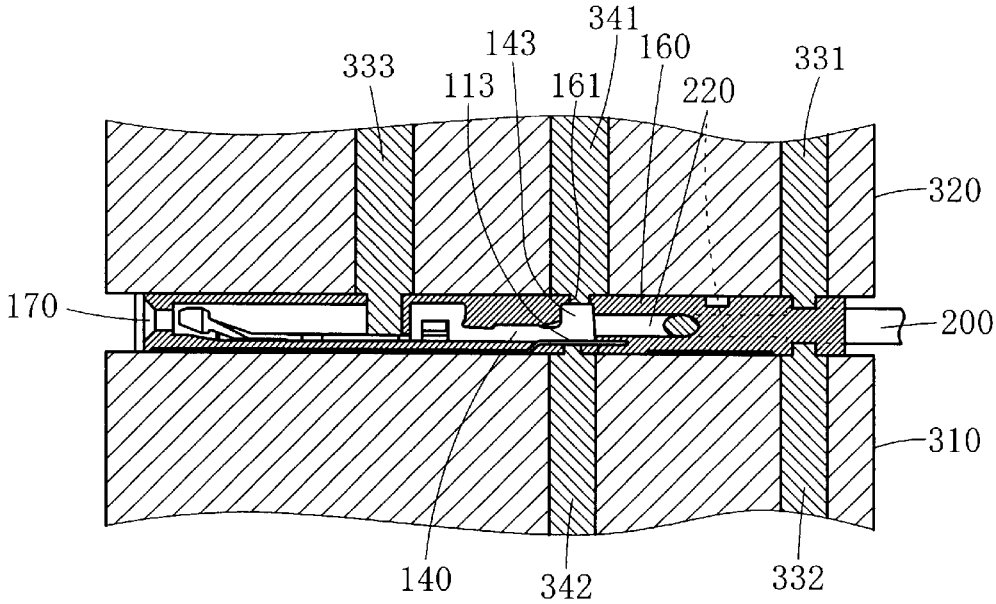
FIG. 19 is a sectional view showing the state after the secondary molding of the second housing in the third process of the production method of the electric connector. The external conductor and the housings are cut, but the ground terminal and the wire near its barrel are not cut.

Now, the method of producing the above-mentioned electric connector 100 will be described. First, the first process, wherein the first housing 120 is molded primarily on the external conductor 110 in molds, is executed to form the connector body 170 (resulting in the form shown in FIG. 8). Next, the second process, wherein at least a part of the molds is opened and the signal terminals 130 having signal lines 210 crimped and the ground terminal 140 having the ground lines 220 crimped are engaged with the first housing 120 of the connector body 170 by means of the engaging mechanism 150, is executed (resulting in the form shown in FIG. 13). Next, the third process is executed, wherein the second housing 160 is molded secondarily while the ground terminal 140 is pressed by a core pin against the support protrusion 113 of the external conductor 110 in the molds. In other words, as shown in FIG. 18, the connector body 170 having the signal terminals 130 and the ground terminal 140 engaged in position is supported in the molds 310, 320 opposing to each other. The cores 331, 332, 333 protruding from the molds 310, 320 press certain parts of the connector body 170. Furthermore, in the molds 310, 320, while the ground terminal 140 is pressed by the core pin 341 against the support protrusion 113 of the external conductor 110 and the support protrusion 113 is pressed by another core pin 342, which is arranged to oppose to the core pin 341, and as shown in FIG. 19, a synthetic resin is injected into an area around the support protrusion 113 to secondarily mold the second housing 160. In this case, a through hole is formed in the first housing 120 by the core pin 342 contacting the support protrusion 114.

Accordingly, in the electric connector 100 of the above-mentioned first embodiment, as the second housing 160 is secondarily molded on the ground terminal 140, the ground terminal 140 contacts hard the external conductor 110, and in turn, the reliability of connection between them is enhanced, and stable impedance characteristics are obtained. This, in turn, allows stable high-speed transmission of signals. Each signal line 210 of the shielded cable 200 is crimped in the barrel 133 of the signal terminal 130, and the ground line 220 of the shielded cable 200 is crimped in the barrel 143 of the ground terminal 140, and the ground terminal 140 is made to contact the support protrusion 113 of the external conductor 110. As a result, there is no soldering process, the work processes are reduced and the producibility is improved, and moreover, the impedance characteristics of the products are equalized. Furthermore, as the major components are formed by laying up the plate-shaped external conductor 110, the first housing 120, the signal terminals 130 and the ground terminal 140, and the second housing 160, the electric connector 100 can be made thinner, and this is advantageous when such electric connectors 100 are used in layers.

When the second housing 160 is secondarily molded, as the core pin 341 presses the ground terminal 140 against the support protrusion 113 at the position of the through hole 161, the ground terminal 140 will not be shifted or deformed under the pressure of the insulating material being secondarily molded and the insulating material will not enter between the ground terminal 140 and the support protrusion 113. Hence the secondary molding is effectively prevented from causing any defective connection between the ground terminal 140 and the external conductor 110.

The present invention does not limit which part of the ground terminal contacts the support protrusion. In the electric connector 100 of the above-mentioned embodiment, the ground terminal 140 has the bottom plate 141 and a barrel 143 rising from the bottom plate 141, and the ground terminal 140 contacts the support protrusion 113 by this bottom plate 141. With this arrangement, as the ground terminal 140 contacts the support protrusion 113 by the bottom plate 141, which is harder to be deformed than any other parts of the ground terminal 140, the ground terminal 140 and the support protrusion 113 will contact each other reliably.

The present invention includes embodiments wherein the outside of the support protrusion does not contact the first housing and is freely opened. Among them, in the electric connector 100 of the above-mentioned embodiment, the support protrusion 113 protrudes inside of the first housing 120, and the outside of the support protrusion 113 contacts the first housing 120 and is supported by the first housing 120. With this arrangement, even when the support protrusion 113 receives the pressing force of the core pin 341 via the ground terminal 140, the pressing force will be received by the first housing 120 as well, and in turn, the deformation of the support protrusion 113 will be reduced correspondingly, and any defective connection between the ground terminal and the support protrusion will be prevented.

As the method of producing the electric connector 100 of the above-mentioned first embodiment is free of any soldering process, the work processes are reduced and the producibility is enhanced, and the impedance characteristics of the products are equalized.

In the third process, in the molds 310, 320, the second housing 160 is molded secondarily while the ground terminal 140 is pressed by the core pin 341 against the support protrusion 113 of the external conductor 110, the through hole 161 will be formed by the core pin 341 in the second housing 160 at a position wherein the core pin 341 faces the support protrusion 113 with the ground terminal 140 in between. In that case, as the core pin 341 presses the ground terminal 140 against the support protrusion 113, the ground terminal 140 will not be shifted or deformed under the pressure of the insulating material being molded secondarily, and the insulating material will not enter between the ground terminal 140 and the support protrusion 113. Hence the secondary molding is effectively prevented from causing any defective connection between the ground terminal 140 and the external conductor 110.

The present invention includes embodiments wherein another pin 342 is not provided. Among them, in the third process of the method of production of the above-mentioned embodiment, the support protrusion 113 is pressed by another core pin 342, which is arranged to oppose to the above-mentioned core pin 341. With this arrangement, even when the support protrusion 113 receives the pressing force of the core pin 341 via the ground terminal 140, this pressing force will be received by the other core pin 342 as well, and deformation of the support protrusion 113 will be reduced accordingly. Thus defective connection between the ground terminal 140 and the support protrusion 113 will be prevented.

Figure 20:
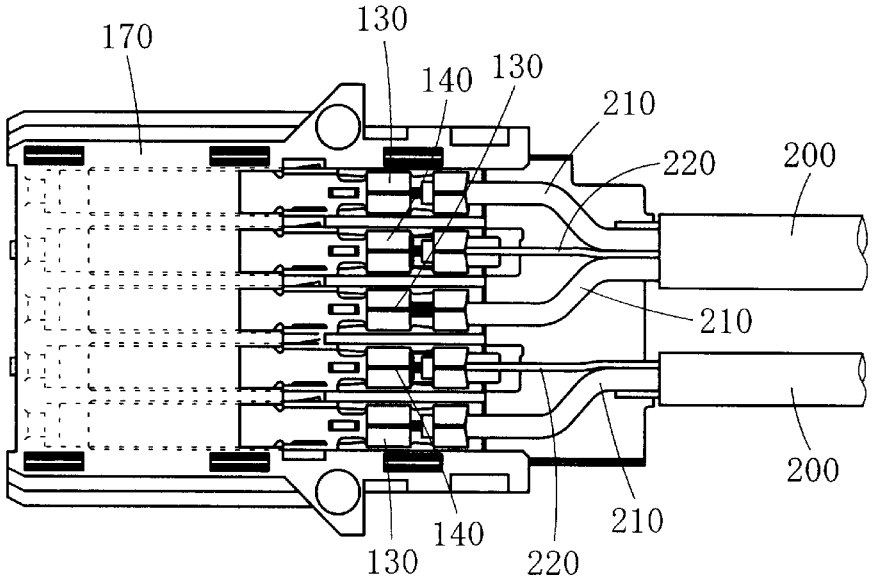
FIG. 20 is a plan view of the second embodiment of the electric connector according to the present invention, without a second housing.

FIG. 20 shows an electric connector 100 of the second embodiment. In the first embodiment, as only one ground terminal 140 is provided, there are one support protrusion 113 and one core pin 341. In contrast to it, in the electric connector 100 of the second embodiment, there are two ground terminals 140, and correspondingly there are two support protrusions 113 and two core pins 341. The operations and effects of this electric connector 100 are similar to those of the first embodiment.

The present invention includes embodiments of the electric connector wherein the outside of the support protrusion does not contact the first housing and is free, and embodiments wherein a support protrusion is formed at a part of the external conductor at which the first housing is not formed. When such an electric connector is produced without pressing the support protrusion by another core pin 342, it is preferable that the support protrusion itself has a sufficient rigidity that can bear the pressing force of the core pin 341.

With the description of these embodiments, the first electric connector for shielded cable, which was described in the summary of the invention, has been fully disclosed. Moreover, with the description of these embodiments, the second electric connector, the third electric connector, the connector body, the first production method of the electric connector, and the second production method of the electric connector, all of which will be described below, have been fully described.

The second electric connector for shielded cable is the above-mentioned first electric connector for shielded cable, wherein the ground terminal comprises a bottom plate and a barrel that rises from the bottom plate, and the ground terminal contacts the support protrusion by this bottom plate.

With this arrangement, as the ground terminal contacts the support protrusion by its bottom plate, which is harder to be deformed among any parts of the ground terminal, both the ground terminal and the support protrusion will contact each other reliably, and occurrence of defective connection between them can be prevented more reliably.

The third electric connector for shielded cable is the above-mentioned first or second electric connector for shielded cable, wherein the support protrusion protrudes inside of the first housing, and the outside of the support protrusion contacts the first housing and is supported by the first housing.

With this arrangement, even when the support protrusion receives the pressing force of the core pin via the ground terminal, this pressing force will be received by the first housing as well, and the deformation of the support protrusion will be reduced accordingly. Thus defective connection between the ground terminal and the support protrusion will be prevented.

The connector body to be used for any one of the above-mentioned first through third electric connectors for shielded cable comprises the conductive plate-shaped external conductor, and the insulating first housing that is primarily molded on the inside of the external conductor, wherein the external conductor is provided with the support protrusion that protrudes inside of the external conductor and can contact the ground terminal, and at least a part of the engaging mechanism for engaging the signal terminal and the ground terminal is provided on the inside of the first housing.

When the signal terminal having signal line crimped and the ground terminal having ground line crimped are engaged by the engaging mechanism with the first housing of the connector body, and the second housing is secondarily molded while the ground terminal is pressed by the core pin against the support protrusion of the external conductor, any one of the first through third electric connectors will be produced. This connector body is suitable as a connector body for producing any of the first through third electric connectors.

The first method of producing any one of the above-mentioned first through third electric connectors for shielded cable comprises a first process of primarily molding the first housing on the external conductor in the molds, a second process of engaging the signal terminal having the signal line crimped and the ground terminal having the ground line crimped with the first housing by the engaging mechanism, and a third process of secondarily molding the second housing while the ground terminal is pressed by the core pin against the support protrusion of the external conductor in the molds.

As this production method is free of any soldering process, the work processes are reduced and the producibility is enhanced, and the impedance characteristics of the products are equalized.

In the third process, as the second housing is secondarily molded while the ground terminal is pressed by the core pin against the support protrusion of the external conductor in the molds, a through hole will be formed by the core pin in the second housing at a point at which the core pin faces the support protrusion with the ground terminal in between. In that case, as the core pin presses the ground terminal against the support protrusion, the ground terminal will not be shifted or deformed under the pressure of the insulating material being secondarily molded, and the insulating material will not enter between the ground terminal and the support protrusion. Hence the secondary molding is effectively prevented from causing any defective connection between the ground terminal and the external conductor.

With the description of the first method of producing the electric connector for shielded cable, a suitable method of producing any one of the first through third electric connectors for shielded cable has been disclosed.

The second method of producing the electric connector for shielded cable is the first method of producing the electric connector for shielded cable, wherein in the third process, the support protrusion is pressed by another core pin that is arranged to oppose to the above-mentioned core pin.

With this arrangement, even when the support protrusion receives the pressing force of the core pin via the ground terminal, this pressing force will be received by the other core pin as well, the deformation of the support protrusion will be reduced accordingly, and defective connection between the ground terminal and the support protrusion will be prevented.

What is claimed is:

1. An electric connector for connecting shielded cable having a signal line and a ground line, the electric connector comprising:

a conductive plate-shaped external conductor, an insulating first housing being primarily molded on the inside of the external conductor, a signal terminal having a contacting part at one end thereof, which contacts a counterpart terminal, and a barrel on the other end thereof, which crimps the signal line of the shielded cable, and being arranged on the inside of the first housing in one direction, a ground terminal having a contacting part at one end thereof, which contacts a counterpart terminal, and a barrel on the other end thereof, which crimps the ground line of the shielded cable, and being arranged on the inside of the first housing in the same direction as the signal terminal, a engaging mechanism for engaging the signal terminal and the ground terminal onto the first housing, and an insulating second housing being secondarily molded to sandwich the signal terminal and the ground terminal between itself and the first housing, wherein the external conductor is provided with a support protrusion, which is formed to protrude inside of the external conductor to contact the ground terminal, and the second housing is provided with a through hole, which is formed by a core pin that protrudes inward from a mold and presses the ground terminal, at a position where the second housing faces the support protrusion with the ground terminal in between.

2. An electric connector for shielded cable as recited in claim 1, wherein the ground terminal comprises a bottom plate and a barrel that rises from the bottom plate, and the ground terminal contacts the support protrusion by the bottom plate.

3. An electric connector for shielded cable as recited in claim 1, wherein the support protrusion protrudes inside of the first housing, and the outside of the support protrusion contacts the first housing and is supported by the first housing.

4. An electric connector for shielded cable as recited in claim 2, wherein the support protrusion protrudes inside of the first housing, and the outside of the support protrusion contacts the first housing and is supported by the first housing.

5. A connector body to be used for the electric connector for shielded cable as recited in claim 1, the connector body comprising the conductive plate-shaped external conductor, and the insulating first housing that is primarily molded on the inside of the external conductor, wherein the external conductor is provided with the support protrusion that protrudes inside of the external conductor and can contact the ground terminal, and at least a part of the engaging mechanism for engaging the signal terminal and the ground terminal is provided on the inside of the first housing.

6. A connector body to be used for the electric connector for shielded cable as recited in claim 2, the connector body comprising the conductive plate-shaped external conductor, and the insulating first housing that is primarily molded on the inside of the external conductor, wherein the external conductor is provided with the support protrusion that protrudes inside of the external conductor and can contact the ground terminal, and at least a part of the engaging mechanism for engaging the signal terminal and the ground terminal is provided on the inside of the first housing.

7. A connector body to be used for the electric connector for shielded cable as recited in claim 3, the connector body comprising the conductive plate-shaped external conductor, and the insulating first housing that is primarily molded on the inside of the external conductor, wherein the external conductor is provided with the support protrusion that protrudes inside of the external conductor and can contact the ground terminal, and at least a part of the engaging mechanism for engaging the signal terminal and the ground terminal is provided on the inside of the first housing.

8. A connector body to be used for the electric connector for shielded cable as recited in claim 4, the connector body comprising the conductive plate-shaped external conductor, and the insulating first housing that is primarily molded on the inside of the external conductor, wherein the external conductor is provided with the support protrusion that protrudes inside of the external conductor and can contact the ground terminal, and at least a part of the engaging mechanism for engaging the signal terminal and the ground terminal is provided on the inside of the first housing.

9. A method of producing the electric connector for shielded cable as recited in claim 1, the method comprising:

a first process of primarily molding the first housing on the external conductor in molds, a second process of engaging the signal terminal having the signal line crimped and the ground terminal having the ground line crimped with the first housing by the engaging mechanism, and a third process of secondarily molding the second housing while the ground terminal is pressed by the core pin against the support protrusion of the external conductor in the molds.

10. A method of producing the electric connector for shielded cable as recited in claim 2, the method comprising:

a first process of primarily molding the first housing on the external conductor in molds, a second process of engaging the signal terminal having the signal line crimped and the ground terminal having the ground line crimped with the first housing by the engaging mechanism, and a third process of secondarily molding the second housing while the ground terminal is pressed by the core pin against the support protrusion of the external conductor in the molds.

11. A method of producing the electric connector for shielded cable as recited in claim 3, the method comprising:

a first process of primarily molding the first housing on the external conductor in molds, a second process of engaging the signal terminal having the signal line crimped and the ground terminal having the ground line crimped with the first housing by the engaging mechanism, and a third process of secondarily molding the second housing while the ground terminal is pressed by the core pin against the support protrusion of the external conductor in the molds.

12. A method of producing the electric connector for shielded cable as recited in claim 4, the method comprising:

a first process of primarily molding the first housing on the external conductor in molds, a second process of engaging the signal terminal having the signal line crimped and the ground terminal having the ground line crimped with the first housing by the engaging mechanism, and a third process of secondarily molding the second housing while the ground terminal is pressed by the core pin against the support protrusion of the external conductor in the molds.

13. A method of producing the electric connector for shielded cable as recited in claim 9, wherein in the third process, the support protrusion is pressed by another core pin that is arranged to oppose to the core pin.

14. A method of producing the electric connector for shielded cable as recited in claim 10, wherein in the third process, the support protrusion is pressed by another core pin that is arranged to oppose to the core pin.

15. A method of producing the electric connector for shielded cable as recited in claim 11, wherein in the third process, the support protrusion is pressed by another core pin that is arranged to oppose to the core pin.

16. A method of producing the electric connector for shielded cable as recited in claim 12, wherein in the third process, the support protrusion is pressed by another core pin that is arranged to oppose to the core pin.

* * * * *